US007063272B2

(12) United States Patent
Cooke et al.

(10) Patent No.: US 7,063,272 B2
(45) Date of Patent: Jun. 20, 2006

(54) FUEL INJECTION NOZZLE AND METHOD OF MANUFACTURE

(75) Inventors: Michael Peter Cooke, Gillingham (GB); Godfrey Greeves, Hatch End (GB); Louise A Connelly, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/226,843

(22) Filed: Sep. 13, 2005

(65) Prior Publication Data

US 2006/0060675 A1 Mar. 23, 2006

(30) Foreign Application Priority Data

Sep. 17, 2004 (EP) ..... 04255676
Oct. 15, 2004 (EP) ..... 04256368

(51) Int. Cl.
*F02M 47/02* (2006.01)

(52) U.S. Cl. ..... 239/88; 239/533.3; 239/533.4; 239/533.11; 239/533.12; 29/890.126; 29/890.124; 29/890.122

(58) Field of Classification Search ..... 239/88, 239/533.3, 533.4, 533.11, 533.12, 585.1, 239/533.5, 5; 29/890.126, 890.124, 890.122
See application file for complete search history.

(56) References Cited

U.S. PATENT DOCUMENTS 4,382,554 A * 5/1983 Hofmann ..... 239/533.9
4,407,457 A * 10/1983 Seifert ..... 239/533.12
4,857,696 A 8/1989 Taeusch et al.
5,899,389 A * 5/1999 Pataki et al. ..... 239/533.2
6,338,445 B1 * 1/2002 Lambert et al. ..... 239/533.12
2004/0055562 A1 3/2004 Stewart et al.

FOREIGN PATENT DOCUMENTS

WO WO 03/018991 6/2003

* cited by examiner

*Primary Examiner*—Dinh Q. Nguyen
(74) *Attorney, Agent, or Firm*—David P. Wood

(57) ABSTRACT

An injection nozzle (10), for use in a fuel injector for an internal combustion engine, has an inner valve needle (26) which is engageable with an inner valve seating (24, 58) to control fuel delivery through one or more first nozzle outlets (14), and an outer valve (28) which is engageable with an outer valve seating (24, 70) to control fuel delivery through one or more second outlets (16). The outer valve (28) is provided with a valve bore (36) within which at least a part of the inner valve needle (26) is received. Coupling means (46, 48) are provided for coupling movement of the inner valve needle (26) to the outer valve (28) in circumstances in which the inner valve needle (26) is moved away from the inner valve seating (24, 58) through an amount exceeding a predetermined threshold amount (D). This allows the outer valve (28) to be lifted away from the outer valve seating (24, 70) to provide an increased injection rate. If only a reduced injection rate is required the inner valve needle (26) need only be lifted through an amount less than the threshold amount.

20 Claims, 7 Drawing Sheets

FUEL INJECTION NOZZLE AND METHOD OF MANUFACTURE

TECHNICAL FIELD

The present invention relates to fuel injection nozzle including an inner valve needle and an outer valve, each of which controls the delivery of fuel into the combustion chamber of an internal combustion engine. In particular, the invention relates to an injection nozzle in which the outer valve is co-operable with one outlet to control fuel delivery to the engine and the inner valve needle is co-operable with another outlet to control fuel delivery to the engine. The invention also relates to a method of manufacturing an injection nozzle of the aforementioned type.

BACKGROUND TO THE INVENTION

In a known injection nozzle, commonly referred to as a variable orifice nozzle (VON), a nozzle body is provided with a blind bore within which a first, outer valve is movable under the control of an actuator. The bore provided in the nozzle body defines a seating surface with which the outer valve is engageable to control fuel delivery through a first set of nozzle outlets provided at a first axial position along the length of the nozzle body. The outer valve is itself provided with a further bore within which a second, inner valve needle is able to move. The inner valve needle projects through the open end of the further bore in the outer valve and is engageable with the seating surface to control fuel delivery through a second set of outlets provided at a second, lower axial height along the length of the nozzle body.

The outer valve is operable either to move alone, so that the outer valve is lifted away from its seating but the inner valve needle remains seated, or so as to cause the inner valve needle to move also. Movement of the outer valve is transmitted to the inner valve needle, causing the inner valve needle to lift too, in circumstances in which the outer valve is moved through an amount exceeding a predetermined threshold amount. During this stage of operation, both the first and second sets of outlets are opened to give a relatively high fuel delivery rate. If the outer valve is lifted through an amount less than the predetermined threshold amount, the inner valve needle remains seated so that injection only occurs through the first set of outlets at a lower fuel delivery rate.

Variable orifice nozzles of the aforementioned type provide particular advantages for diesel engines, in that they provide the flexibility to inject fuel into the combustion chamber either through the first set of outlets on its own or through both the first and second outlets together. This enables selection of a larger total fuel delivery area for high engine power modes or a smaller total fuel delivery area for lower engine power modes.

A fuel injection nozzle of the aforementioned type is described in our co-pending European patent application EP 04250132.0 (Delphi Technologies Inc.).

It has now been recognised that the performance of existing variable orifice nozzles may be improved further by taking steps to improve the flow efficiency through the nozzle. It is with a view to addressing this issue that an improved injection nozzle is provided by the present invention. A more convenient method of manufacturing the injection nozzle is also provided.

DISCLOSURE OF INVENTION

According to a first aspect of the present invention, there is provided an injection nozzle for use in a fuel injector for an internal combustion engine, the injection nozzle comprising an inner valve needle which is engageable with an inner valve seating to control fuel delivery through one or more first nozzle outlets, an outer valve which is engageable with an outer valve seating to control fuel delivery through one or more second nozzle outlets, wherein the outer valve is provided with a valve bore within which at least a part of the inner valve needle is received, and a coupling arrangement, or coupling means, for coupling movement of the inner valve needle to the outer valve in circumstances in which the inner valve needle is moved away from the inner valve seating through an amount exceeding a predetermined threshold amount, thereby to cause the outer valve to lift away from the outer valve seating also.

In order to inject through the first nozzle outlets only, the inner valve needle is caused to move (for example by an actuator) through only a relatively small amount, being less than the threshold amount, so that the outer valve remains seated. In these circumstances no fuel can flow through the second nozzle outlets. If a higher injection rate is required, the inner valve needle is moved further so as to cause the outer valve to move too as the coupling means comes into play. The invention provides an improved flow efficiency in the nozzle, particularly as larger seats which are controlled by the outer valve feed the larger, second outlets, while the smaller seats controlled by the inner valve needle feed the smaller, first outlets. A further benefit is achieved in that the mechanism required to couple movement of the inner valve needle to the initially-static outer valve can be less complex, and of reduced part count, compared with the equivalent mechanism required in known variable orifice nozzles in which the roles of the needles are the other way around.

Additionally, in circumstances in which only the first nozzle outlets are opened, the majority of the fuel is flowing past only a relatively small seat (that of the inner valve needle), so that controlling the lift of the inner valve needle can be used to throttle the flow to the first nozzle outlets if modulation of the rate of injection is desired.

In a preferred embodiment, the inner valve needle is movable within a valve bore provided in the outer valve.

In a further preferred embodiment, the coupling means is provided by a region defined on the inner valve needle, the region being engageable with a co-operable region of the outer valve in circumstances in which the inner valve needle is moved through an amount equal to the threshold amount, thereby to cause the outer valve to lift in circumstances in which the inner valve needle is moved through an amount which exceeds the threshold amount.

The region of the inner valve needle which co-operates with the outer valve may include an engagement surface which may be defined, for example, between a main stem of the inner valve needle and an enlarged head of the inner valve needle (i.e. a step along the main axis of the inner valve needle).

Preferably, the inner valve needle is provided with upper and lower seating lines, spaced apart axially, one on either side of the first nozzle outlets in circumstances in which the inner valve needle is seated. The upper and lower seating lines are shaped for engagement with upper and lower seats, respectively, of the inner valve seating. The inner valve seating thus has two seats for the inner valve needle, an upper seat and a lower seat, thus sealing the first nozzle outlets from the flow of fuel from both upstream and downstream directions (i.e. upstream of the first outlets and downstream of the first outlets).

Similarly, the outer valve may be provided with upper and lower seating lines, spaced apart axially, one on either side of the second outlets in circumstances in which the outer valve is seated. The upper and lower seating lines are engageable with upper and lower seats, respectively, of the outer valve seating.

In one embodiment, the upper and lower seating lines of the inner valve needle may be defined by upper and lower edges, respectively, of a groove provided on the outer surface of the inner valve needle. The groove may include an upper groove region to define the upper edge and a lower groove region to define the lower edge, both groove regions preferably being of frusto-conical form.

Similarly, the upper and lower seating lines of the outer valve may be defined by upper and lower edges, respectively, of a groove provided on the surface of the outer valve. The groove may include an upper groove region to define the upper edge and a lower groove region to define the lower edge, both groove regions preferably being of frusto-conical form.

The nozzle preferably includes a nozzle body provided with a nozzle bore which houses the inner and outer valves. The nozzle bore also defines an upper delivery chamber for delivering fuel to the first and second outlets and a lower delivery chamber for delivering fuel to the second outlets, wherein the upper and lower delivery chambers are in communication with one another.

Preferably, the inner valve needle defines, at least in part, a flow passage means to allow fuel to flow from the upper delivery chamber to the lower delivery chamber. From the lower delivery chamber, fuel flows to the one or more first outlets in circumstances in which the inner valve needle is lifted from the inner valve seating and flows to the second outlets in circumstances in which the outer valve is lifted from the outer valve seating.

The flow passage means is preferably defined by an axially extending bore provided in the inner valve needle.

Preferably, the inner valve needle is coupled to an actuator, which serves to actuate the inner valve needle, via a load transmitting member. In one embodiment, the load transmitting member defines a part of the flow passage means. Coupling of the inner valve needle to the load transmitting member may be achieved by several means, although an interference fit provides the benefit of convenience.

The load transmitting member may include a guide region which serves to guide movement of the load transmitting member and the inner valve needle, in use.

According to a second aspect of the invention, there is provided an injection nozzle in accordance with the first aspect of the invention and further comprising an actuator for controlling movement of the inner valve needle.

The actuator is preferably coupled to the inner valve needle indirectly via a separate part, for example a load transmitting member. In an alternative embodiment, the actuator may be coupled to the inner valve needle directly (in other words, any load transmitting part is integrally formed with the needle). The actuator may be a piezoelectric actuator, or alternatively an electromagnetic actuator, of the associated injector.

Therefore, the injection nozzle may include an inner valve needle which is engageable with an inner valve seating to control fuel delivery through one or more first nozzle outlets and operable by means of an actuator to move away from the inner valve seating and an outer valve which is engageable with an outer valve seating to control fuel delivery through one or more second nozzle outlets, wherein the outer valve is provided with a valve bore within which at least a part of the inner valve needle is received. The inner valve needle has a region which cooperates with a region of the outer valve in circumstances in which the inner valve needle is moved away from the inner valve seating through an amount exceeding a predetermined threshold amount, thereby to cause the outer valve to lift away from the outer valve seating together with the inner valve needle, and where the regions remain disengaged when the inner valve needle is moved away from the inner valve seating through an amount less than the predetermined threshold amount.

According to a further aspect of the invention, there is provided a method of manufacturing an injection nozzle of the type described in the first aspect of the invention, the method comprising the steps of receiving at least a part of the inner valve needle within the outer valve, providing a grinding wheel having a first surface profile for profiling an outer surface of the inner valve needle and a second surface profile for profiling the outer surface of the outer valve, and grinding the inner and outer valves with the wheel to profile respective seating surfaces thereof, wherein the first and second surface profiles of the grinding wheel are offset from one another so that, when the inner and outer valve are assembled within the nozzle body and engaged with their respective valve seatings, engageable surfaces of the inner and outer valves are separated by the threshold amount.

In one embodiment, the method includes the step of clamping the outer valve into contact with the inner valve needle by engaging an engagement surface of the inner valve needle with a co-operable surface of the outer valve. At least a part of the inner valve needle may be supported directly within a holder or other support means.

The method of manufacture provides a convenient and accurate method for forming the seating surfaces of the inner and outer valves, and for setting the gap between the valves which determines the threshold amount. This is because the only tolerance on the threshold amount is that of the grinding wheel (i.e. a very tight tolerance).

In another embodiment, the inner valve needle may be coupled to a load transmitting member, wherein an upper surface of the outer valve is spaced from a lower surface of the load transmitting member by means of a spacer member, prior to the grinding step. The spacer member may have a thickness selected to be at least equal to the threshold amount.

Alternatively, the thickness of the spacer member may be selected to be greater than the threshold amount. In the latter case, additional finishing steps are required to set the threshold amount correctly once the inner and outer valves have been assembled in the nozzle body, but the method again provides high accuracy setting of the threshold amount.

BRIEF DESCRIPTION OF DRAWINGS

An embodiment of the present invention will now be described, by way of example only, with reference to the accompanying drawings in which.

DETAILED DESCRIPTION OF PREFERRED EMBODIMENTS

Figure 1:
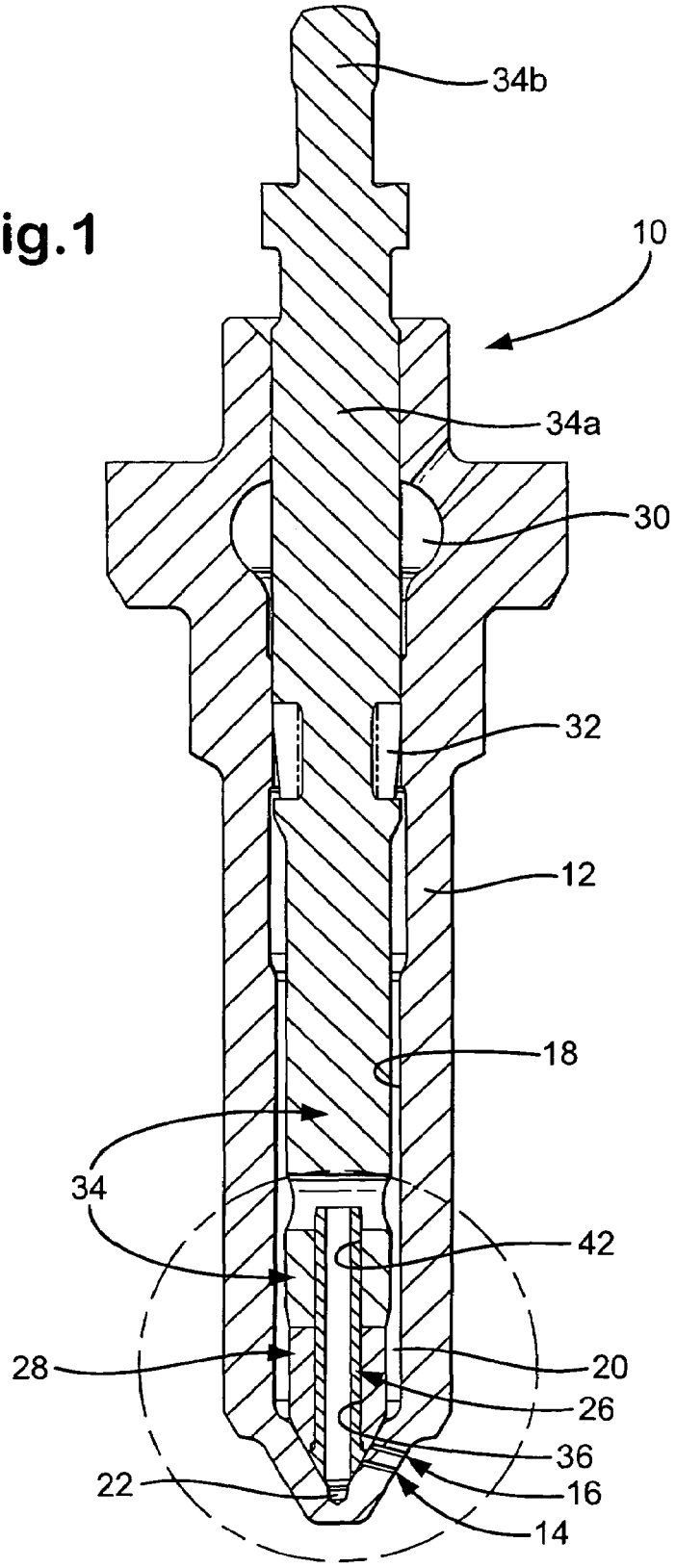
FIG. 1 is a sectional view of a lower part of an injection nozzle of a first embodiment of the invention.
Figure 2:
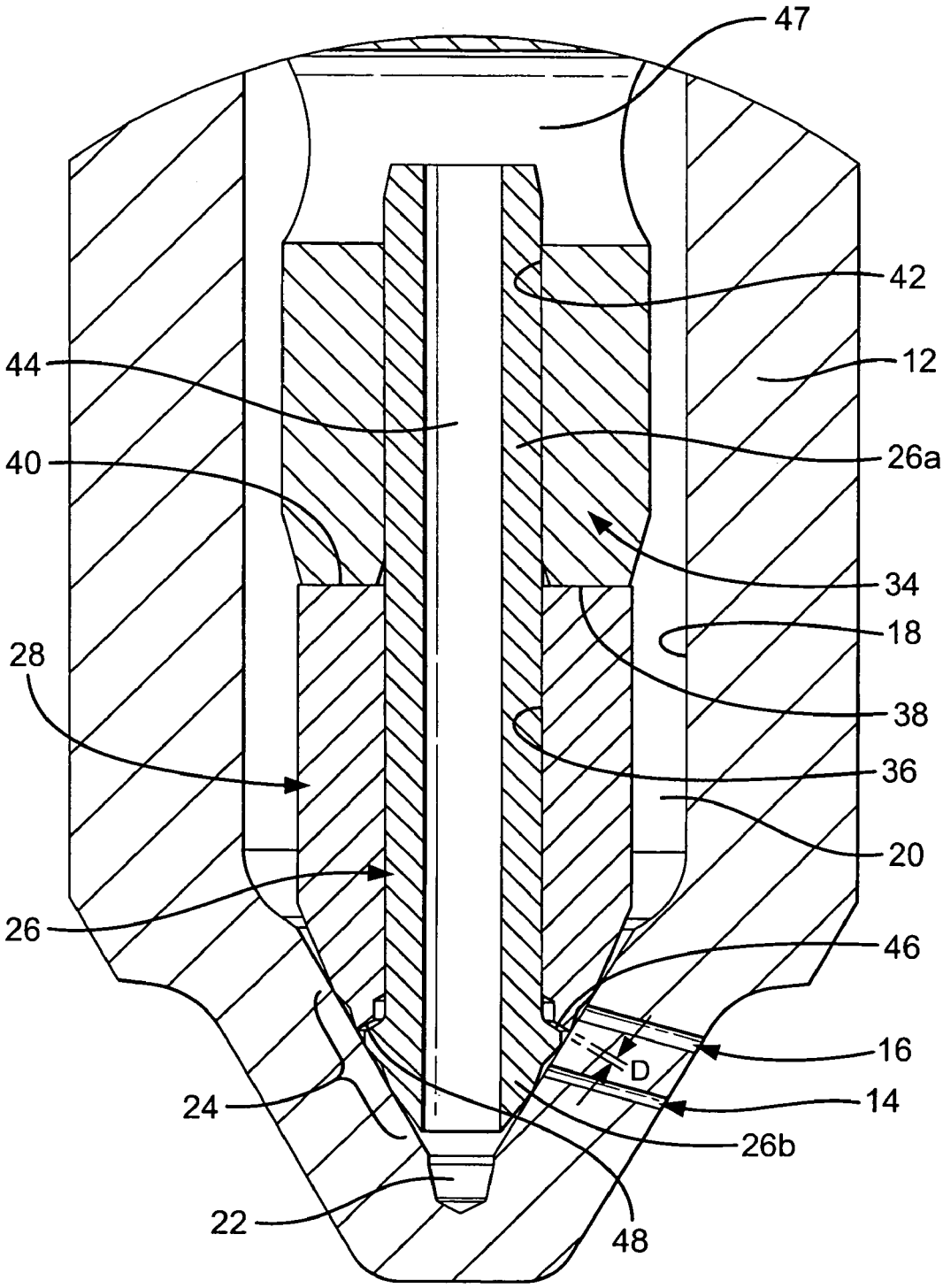
FIG. 2 is an enlarged sectional view of the injection nozzle in FIG. 1 when in a non-injecting position.

The injection nozzle of the present invention is of the type suitable for use in a piezoelectrically controlled fuel injector in which a piezoelectric actuator controls movement of an injector valve needle. Referring to FIGS. 1 and 2, the injection nozzle 10 includes a nozzle body 12 provided with first and second sets of outlets 14, 16 which are spaced axially along the main nozzle body axis so that the second outlets 16 adopt a higher axial position along the nozzle body length than the first outlets 14. As can be seen most clearly in FIG. 2, each of the first outlets 14 is of relatively small diameter to present a low flow area for fuel being injected into the engine, and each of the second outlets 16 is of relatively large diameter so as to present a greater flow area for fuel being injected into the engine. Only a single outlet 14, 16 of each set is shown in FIG. 1, but in practice each set may include more than one nozzle outlet.

The nozzle body 12 is provided with an axially extending blind bore 18 which defines a first, upper delivery chamber 20 for receiving fuel under high pressure. The bore 18 also defines, at its blind end, a second, lower delivery chamber 22 for fuel. The internal surface of the bore 18 is of frusto-conical form at its lower end and here defines a valve seating surface, indicated generally as 24.

First and second coaxially aligned and movable valve members, 26 and 28 respectively, are received within the bore 18 to allow control of the flow of fuel between the upper delivery chamber 20 and the first and second outlets 14, 16. In general terms, the first valve member takes the form of a first, inner valve needle 26, movement of which controls whether or not fuel is delivered through the first outlets 14. The second valve member takes the form of an outer valve 28, movement of which controls whether or not fuel is delivered through the second outlets 16.

The inner valve needle 26 includes two main parts (identified in FIG. 2); a main body or stem 26*a* and an enlarged head 26*b*. An upper portion of the stem 26*a* is coupled to a load transmitting member 34 and a lower portion of the stem 26*a* is received within a bore 36 (referred to as the valve bore) provided in the outer valve 28 so that a lower face 38 of the load transmitting member 34 and an upper face 40 of the outer valve 28 are in contact with one another. The lower region of the stem 26*a* of the inner valve needle 26 forms a close sliding fit within the valve bore 36 so that it is able to move within the outer valve 28, and also so that fuel leakage between the two needles 26, 28 is kept to a minimum. The enlarged head 26*b* of the inner valve needle 26 defines a seating surface of the inner valve needle 26 which is engageable with an inner valve seating, defined by the valve seating surface 24, to control fuel flow through the first outlets 14. The outer valve 28 is shaped or profiled to have a seating surface which is engageable with an outer valve seating. The outer valve seating is defined by the valve seating surface 24 and positioned axially above the inner valve seating in the orientation shown.

The load transmitting member 34 takes the form of an elongate rod or needle which extends through the upper region of the nozzle body bore 18. At its lower end, the load transmitting member 34 is provided with a bore 42 (referred to as the transmitting member bore) which receives, in an interference fit, the stem 26*a* of the inner valve needle 26 to couple the parts securely together. The inner valve needle stem 26*a* projects a short way beyond the open end of the bore 42. This may provide an advantage if it is found that additional welding of the load transmitting member 34 and the needle 26 is required to reinforce the coupling.

Towards its uppermost end (as seen in FIG. 1) the load transmitting member 34 includes a region 34*a* having a diameter substantially equal to that of the nozzle body bore 18 so that co-operation between these parts serves to guide movement of the load transmitting member 34 as it moves, in use. The uppermost end 34*b* of the load transmitting member 34 is coupled, either directly or indirectly, to an actuator (not shown) of the injector, typically in the form of a piezoelectric actuator. The piezoelectric actuator may be of known type, comprising a stack of piezoelectric elements which are caused to extend and contract upon application of a voltage across the stack. It is a feature of the piezoelectric stack that it is housed within a fuel-filled chamber defined within an injector housing part. The chamber housing the stack defines a part of the fuel supply path between an injector inlet, in communication with the common rail, and the nozzle supply chamber 30. In use, fuel is supplied to the injector inlet from a high pressure fuel source, typically in the form of a common rail or accumulator volume, and flows through the stack chamber into a nozzle supply chamber 30 defined by the bore 18. The upper delivery chamber 20 communicates with the nozzle supply chamber 30 via flutes and/or grooves 32 machined on the outer surface of the load transmitting member 34.

Further details of a suitable piezoelectric actuator can be found in our European patent EP 0995901 (Delphi Technologies Inc.). The invention can be implemented equally, however, through use of alternative actuation means, such as an electromagnetic actuator.

The load transmitting member 34 may be provided with an associated spring (not shown) which is located, for example, at the uppermost end 34*b* of the load transmitting member 34 and which serves to urge both this and the inner valve needle 26 in the direction of the valve seating surface 24.

A flow passage means in the form of an axially extending bore or passage 44 is provided through the inner valve needle 26 to allow the passage of fuel through the needle 26 between the upper and lower chambers 20, 22. A radial flow passage 47 is provided in the load transmitting member 34, a central portion of which communicates with a first, upper end of the needle passage 44. A second, lower end of the needle passage 44 communicates with the second delivery chamber 22, and outer ends of the radial flow passage 47 communicate with the upper delivery chamber 20 to establish the flow passage between the upper and lower chambers 20, 22.

The nozzle is provided with a means for coupling the inner valve needle 26 and the outer valve 28 together, so as to cause them to move together in circumstances in which the inner valve needle 26 is moved beyond a certain amount. For this purpose, the inner valve needle 26 is provided with a step 46 along its length, defined between the enlarged head 26*b* of the needle 26 and the needle stem 26*a*. The step 46 defines an engagement surface for engagement with a lower, end surface 48 of the outer valve 28. The engagement surface 46 of the inner valve needle 26 and the end surface 48 of the outer valve 28 are correspondingly shaped so as to make flat surface-to-surface contact when they engage.

In FIGS. 1 and 2, and with the injection nozzle in a non-injecting position, it can be seen that the engagement surface 46 of the inner valve needle 26 and the end surface 48 of the outer valve 28 are spaced apart by a small distance, referred to as D. In use, if the inner valve needle 26 is lifted through an amount which is less than the distance D (referred to as the 'predetermined threshold amount'), no movement of the outer valve 28 will occur as the enlarged head 26*b* of the inner valve needle 26 is not brought into contact with the outer valve 28. If, on the other hand, the inner valve needle 26 is moved through an amount which equals the predetermined threshold amount D, the engagement surface 46 of the inner valve needle 26 is caused to engage with the outer valve 28. If the inner valve needle 26 is then lifted through a further amount, to exceed the threshold amount, the outer valve 28 will be caused to move together with the inner valve needle 26.

Figure 3:
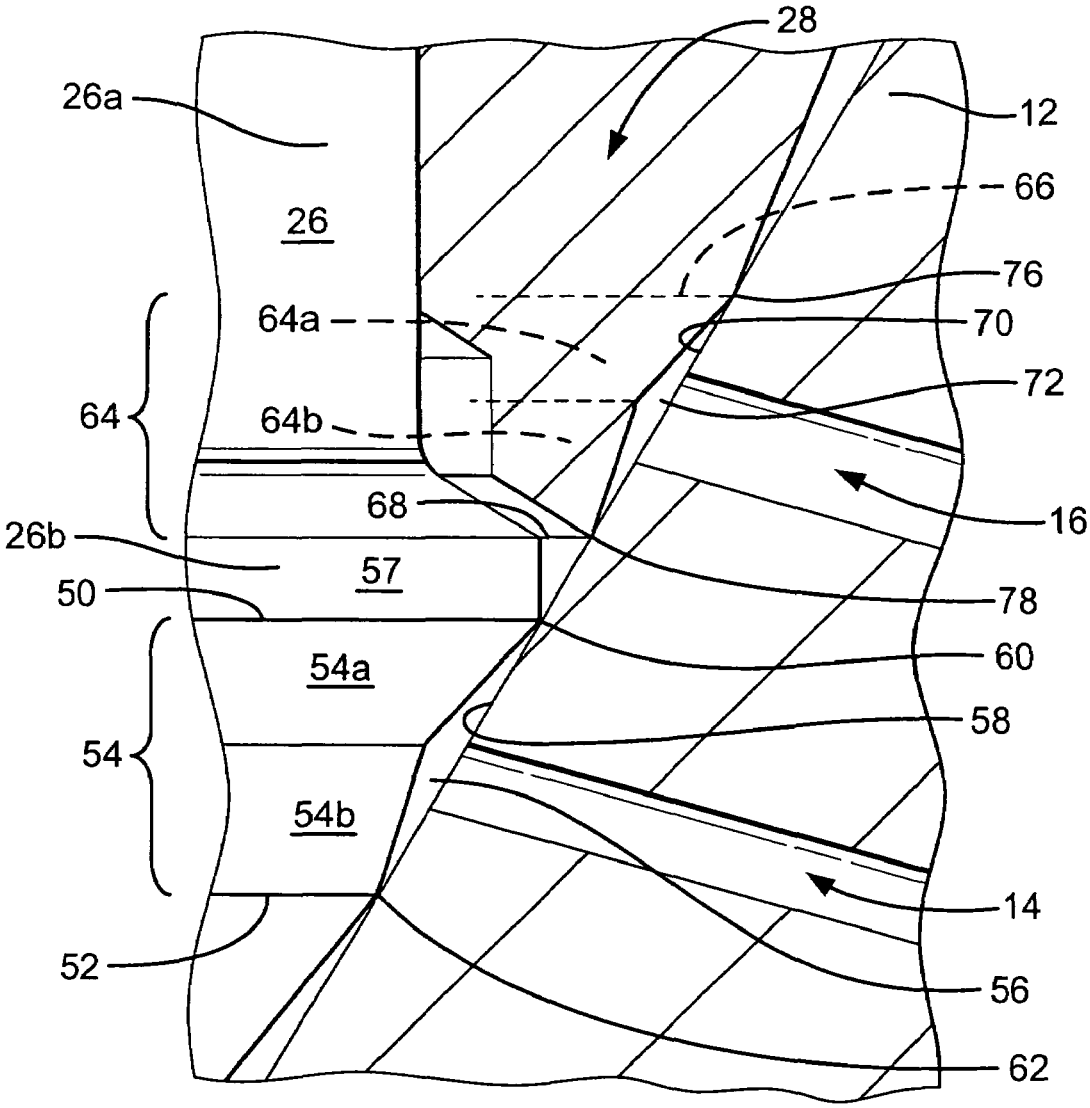
FIG. 3 is an enlarged view of a valve seating surface of the nozzle in FIGS. 1 and 2.

The configuration of the inner and outer valve seatings is an important feature of the embodiment of the invention in FIGS. 1 and 2 and is described in further detail with reference to FIG. 3. The enlarged head 26*b* of the inner valve needle 26 is shaped to define a first (upper) inner valve seating line 50, located upstream of the first outlets 14 when the needle 26 is seated, and a second (lower) inner valve seating line 52, located downstream of the first outlets 14 when the needle 26 is seated (i.e. one seating line 50, 52 on either side of the outlets 14). The inner valve needle 26 is provided with a grooved or recessed region 54 to define, at respective upper and lower edges thereof, the upper and lower seating lines 50, 52. The groove 54 is defined by an upper groove region 54*a* and a lower groove region 54*b*, both regions being of frusto-conical form and defining, together with the adjacent region of an inner valve seating 58, an annular volume 56 for fuel at inlet ends of the first outlets 14. Immediately above the upper groove region 54*a*, the inner valve needle 26 includes a further region 57 of cylindrical or frusto-conical form.

The upper and lower seating lines 50, 52 of the inner valve needle 26 engage with the inner valve seating 58 at respective upper and lower seats 60, 62 thereof, the upper seat 60 being of larger diameter than the lower seat 62 due to its higher axial position along the length of the nozzle body 12.

In a manner similar to that of the inner valve needle 26, the outer valve 28 is provided with a grooved or recessed region 64 to define, at respective upper and lower edges thereof, upper and lower outer valve seating lines 66, 68. The upper and lower seating lines 66, 68 are arranged axially above and below, respectively, the second outlets 16 (i.e. one on either side) in circumstances in which the outer valve 28 is seated. More specifically, the groove 64 in the outer valve 28 includes an upper groove region 64*a* and a lower groove region 64*b* which define, together with the adjacent region of an outer valve seating 70, an annular volume 72 for fuel at the inlet ends of the second outlets 16. The upper seating line 66 and the lower seating line 68 engage with the outer valve seating 70 at respective upper and lower seats 76, 78 thereof, with the upper seat 76 having a greater diameter than the lower seat 78 due to its higher axial position along the length of the nozzle body 12. It will be appreciated, therefore, that it is the lower seat 62 of the inner valve seating 58 that has the smallest diameter of all of the seats 60, 62, 76, 78.

Figure 4:
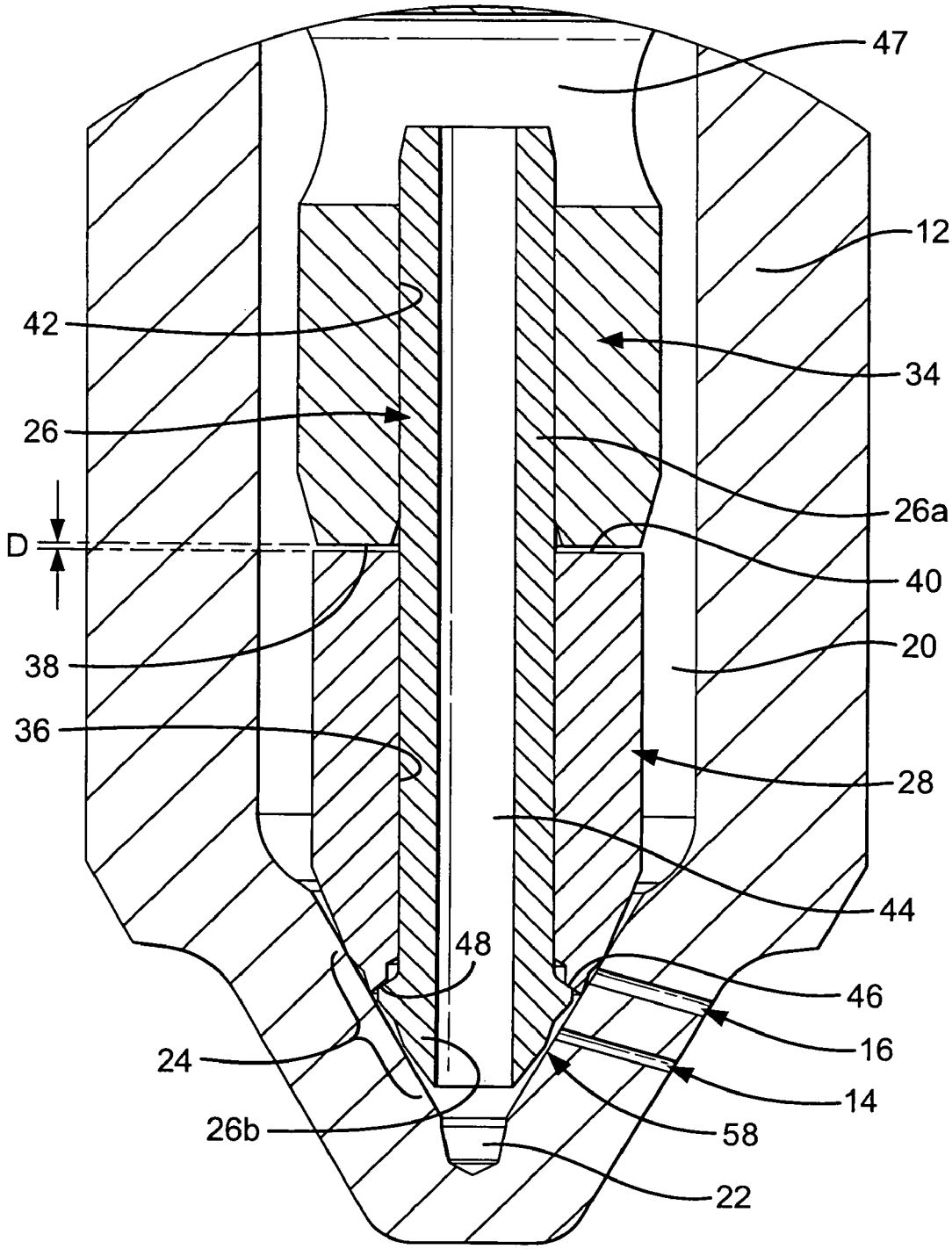
FIG. 4 is a sectional view of the injection nozzle in FIGS. 1 and 2 when in a first injecting position.
Figure 5:
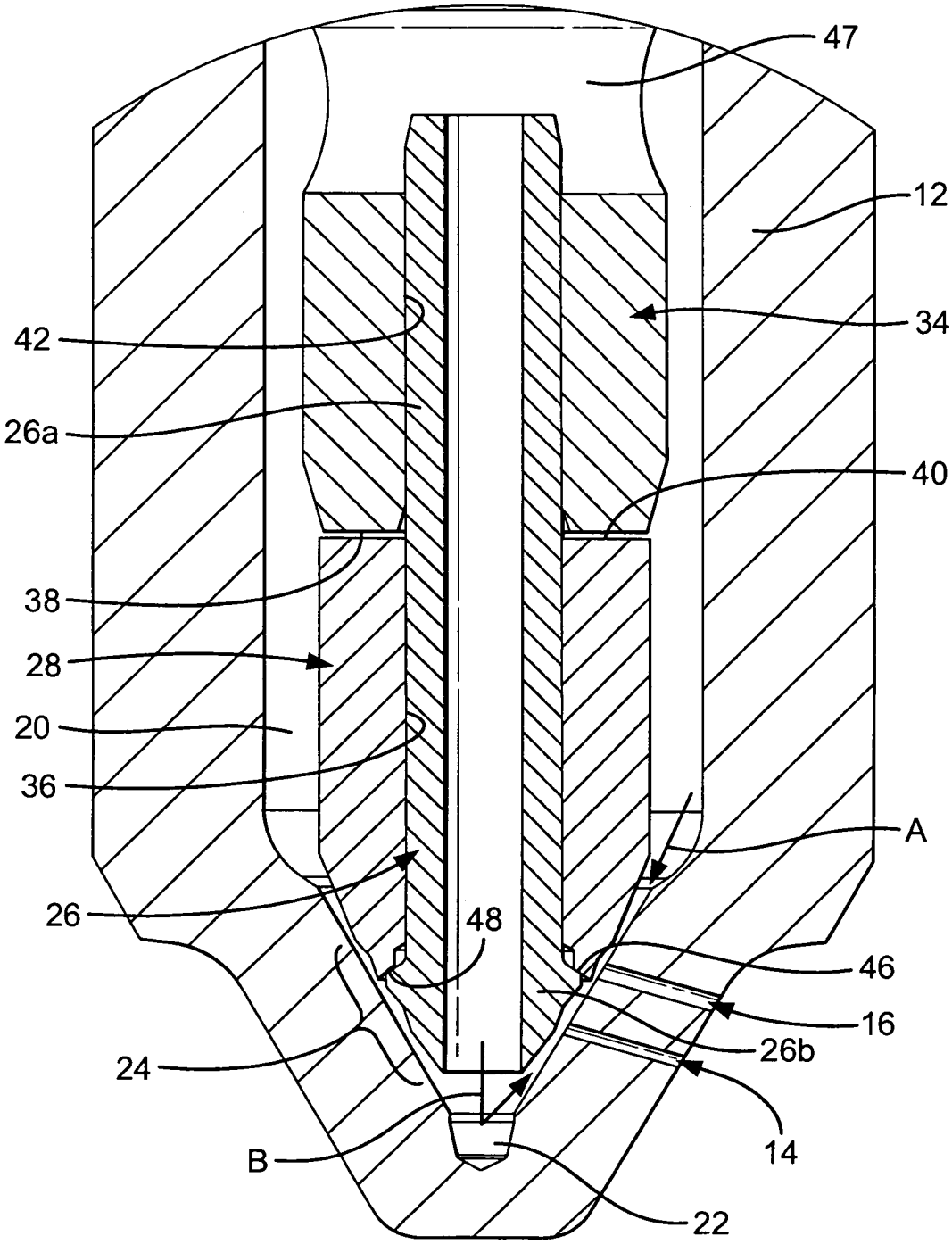
FIG. 5 is a sectional view of the injection nozzle in FIG. 4 when in a second injecting position.

Operation of the injection nozzle in FIGS. 1 to 3 will now be described with further reference to FIGS. 4 and 5. When in a non-injecting position (as shown in FIG. 3), the piezoelectric actuator stack is fully energised at a first, relatively high energisation level and the inner valve needle 26 is biased into engagement with the inner valve seating 58 by means of the spring acting on the load transmitting member 34. The upper seating line 50 of the inner valve needle 26 therefore engages the upper seat 60 of the inner valve seating 58 and the lower seating line 52 of the inner valve needle 26 engages the lower seat 62 of the inner valve seating 58. With both seats 60, 62 closed and sealed, fuel is unable to flow through the first outlets 14. Similarly, the outer valve 28 is seated against the outer valve seating 70 so that the upper seating line 66 of the outer valve 28 engages with the upper seat 76 of the outer valve seating 70 and the lower seating line 68 engages with the lower seat 78 of the outer valve seating 70. With both seats 76, 78 closed and sealed, fuel is unable to flow through the second outlets 16.

In order to inject through the first outlets 14 only (i.e. a first injecting state), the piezoelectric actuator is de-actuated to a first, lower energisation level. As a result the piezoelectric stack is caused to contract, thus causing the load transmitting member 34 to be lifted in a direction away from the valve seating surface 24. As a result, the inner valve needle 26 is lifted away from the inner valve seating 58 by a first amount which is less than the threshold amount D. This is the position of the nozzle shown in FIG. 4. With the inner valve needle 26 lifted through this first amount, the seal between the lower inner valve seating line 52 and the lower seat 62 is broken. In such circumstances, fuel within the upper delivery chamber 20 is able to flow through the radial passage 47 in the load transmitting member 34, into the axial passage 44 in the inner valve needle 26, into the lower delivery chamber 22 and past the lower seat 62 into the annular volume 56 and the first outlets 14.

As the inner valve needle 26 is only moved through an amount which is less than the threshold amount D, the upper surface 46 of the enlarged head 26*b* of the inner valve needle 26 does not come into engagement with the end surface 48 of the outer valve 28. The outer valve 28 therefore remains seated at this time and the second outlets 16 remain closed so that fuel within the upper delivery chamber 20 is unable to flow past the upper seat 76 of the outer valve seating 70 into the second outlets 16. Likewise, the lower seat 78 for the outer valve 28 remains closed by the lower seating line 68 so that fuel within the lower delivery chamber 22 is also unable to flow out through the second outlets 16. In such circumstances, only a relatively low rate of flow of fuel is injected into the engine through the first, relatively small set of outlets 14. As the majority of the flow (excluding minimal guide leakage between the inner and outer valves 26, 28) is flowing past only a relatively small seat (that of the lower seat 62), controlling the lift of the inner valve needle 26 can be used to throttle the flow to the first outlets 14 if modulation of the rate of injection is desired. This provides a rate shaping capability which may be beneficial in certain applications.

If injection is to be terminated, the piezoelectric actuator is energised to the initial, relatively high level so as to allow the inner valve needle 26 to return to its seated position under the spring force (acting via the load transmitting member 34), in which position the upper and lower seating lines 50, 52 of the inner valve needle 26 engage with their respective upper and lower seats 60, 62. The flow of fuel between the lower delivery chamber 22 and the first outlets 14 is therefore broken, injection stops and the injection nozzle again adopts the position shown in FIG. 2.

Alternatively, if it is desired to inject fuel at a higher injection rate, the piezoelectric actuator is de-energised to a second, lower energisation level causing the stack to contract further. As a result, the load transmitting member 34 is moved further in a direction away from the valve seating surface 24, thereby causing the inner valve needle 26 to be lifted through a further amount in excess of the threshold amount D. The engagement surface 46 of the enlarged head 26*b* of the inner valve needle 26 is brought into contact with the end surface 48 of the outer valve 28 and, as the inner valve needle 26 lifts beyond the distance D, a lifting force is transmitted to the outer valve 28 causing this to lift too. As the upper and lower seating lines 66, 68 of the outer valve 28 are caused to disengage from their respective seats 76, 78, fuel is able to flow through the second outlets 16 from the upper delivery chamber 20 past the upper seat 76 of the outer valve 28, and also from the lower delivery chamber 22 past the inner valve seating 58 and the lower seat 78 of the outer valve 28. In such circumstances, the flow of fuel occurs through both the first and second outlets 14, 16 at a relatively high rate. This is the second injecting position of the nozzle, as shown in FIG. 5.

It will be appreciated that by virtue of the provision of the axial flow passage 44 in the inner valve needle 26 and the radial flow passage 47 in the load transmitting member 34, the flow of fuel through the first and second outlets 14, 16 in the second injecting position has two flow routes from the upper delivery chamber 20. In the case of the first outlets 14, fuel is able to flow either directly through a primary delivery path (indicated by arrow A in FIG. 5) past the inner and outer valve seatings 58, 70, or is able to flow indirectly through a secondary delivery path (indicated by arrow B) through the passages 44, 47 and past the lower seat 62 of the inner valve seating 58. Similarly, in the case of the second outlets 16, fuel is able to flow either directly through the primary delivery path (arrow A) past the upper seat 76 of the outer valve seating 70, or is able to flow indirectly through the secondary delivery path (arrow B) through the flow passages 44, 47, past the inner valve seating 58 and the lower seat 78 of the outer valve seating 70. The relative proportion of fuel flow through the outlets 14, 16 via the primary and secondary flow routes will be determined by the relative sizes and/or number of the first and second outlets 14, 16, the overall flow area presented by each the first and second outlets 14, 16 and the extent of lift of the valves 26, 28.

If it is required to terminate injection from the second fuel injecting position, the piezoelectric actuator is energised to the initial, high energisation level, thereby causing the stack to extend. The load transmitting member 34 is urged, by means of the spring, in a direction which causes the inner valve needle 26 to engage with the inner valve seating 58. Likewise, the load transmitting member 34 acts on the outer valve 28, closing the gap D to cause the outer valve 28 to be urged against the outer valve seating 70 also. Thus, the nozzle returns to the non-injecting position shown in FIG. 2.

It is a particular benefit of the injection nozzle of the present invention that it is possible to inject fuel at relatively low injection rates by lifting only the inner valve needle 26, or to inject fuel at a higher injection rate by lifting both the outer and inner valve needles 28, 26. This enables a so-called boot-shaped injection profile to be achieved, which has been found to have benefits for exhaust emissions. Furthermore, the smaller flow area of the first outlets 14 is fed by the relatively smaller diameter seats 60, 62 of the inner valve needle 26, whereas the higher flow area of the second outlets 16 is fed by the larger diameter seats 76, 78 of the outer valve 28. This improves flow efficiency in the nozzle; a benefit which is not realised in known variable orifice nozzles in which the outer valve is actuated so as to lift first, with the inner valve needle being lifted only as a consequence of outer valve movement beyond a predetermined amount.

Various modifications of the nozzle are envisaged, whilst maintaining the aforementioned advantages. For example, it is an option to form the inner valve needle 26 and the load transmitting member 34 as one part so that the inner valve needle is an integral part of the mechanism which is coupled directly to the actuator. Furthermore, alternative flow passage means are envisaged for providing the necessary flow route between the upper and lower delivery chambers 20, 22, for example oblique or helical passages. The coupling means between the inner and outer valves may also be implemented in a different form, through different shaping of the inner and outer valves or through the provision of additional parts for coupling the two needles together.

Figure 6:
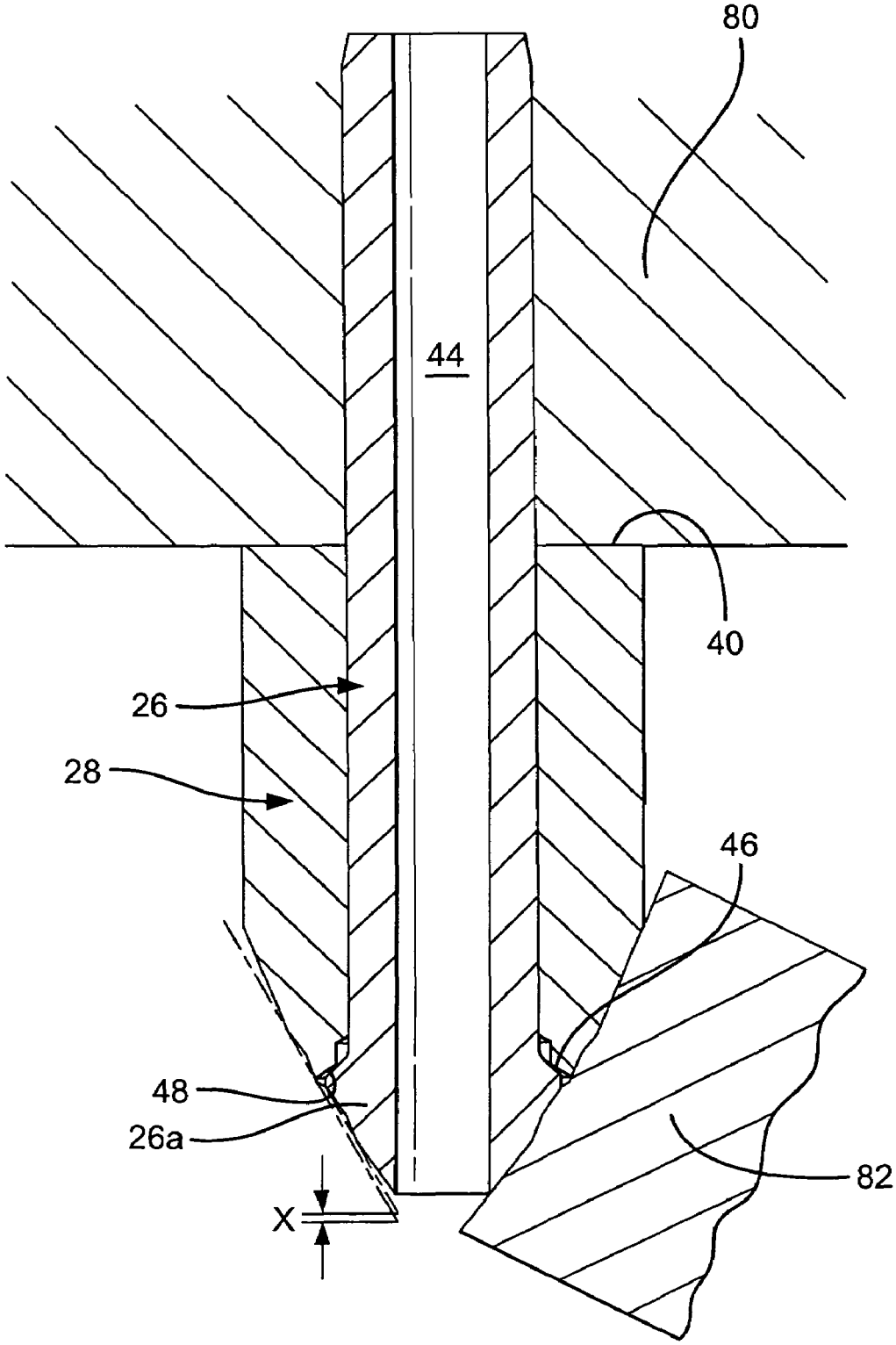
FIG. 6 is a sectional view of an injection nozzle as in FIGS. 1 to 5 to illustrate a first example of a manufacturing process.

The present invention also provides a manufacturing advantage as the nozzle parts can be machined and assembled more conveniently than known variable orifice nozzles. With reference to FIG. 6, there now follows a description of one method by which the injection nozzle of FIGS. 1 to 5 may be assembled. It is an important step in the method of manufacture that the gap D between the engagement surface 46 of the inner valve needle 26 and the end surface 48 of the outer valve 28 is set with high precision and accuracy, as it is this gap which determines the extent of lift of the inner valve needle 26 at which the outer valve 28 is caused to lift too (i.e. the changeover between injection at a low rate and injection at a higher rate).

Initially, the outer valve 28 and the inner valve needle 26 are loaded together into a holder, chuck or other means of support 80. The inner valve needle 26 is supported directly in the holder 80 while the outer valve 28 is clamped in position between the underside of the holder 80 and through contact of its lower surface 48 with the engagement surface 46 of the inner valve needle 26. The inner and outer valves 26, 28 are both ground simultaneously by means of a grinding wheel 82 having the necessary profile to form the upper and lower seating lines, 66, 68 and 50, 52 respectively, of each valve part. The profile of the grinding wheel 82 has a first profile region shaped to form the seating surface (i.e. seating lines 50, 52) on the inner valve needle 26, and a second profile region shaped to form the seating surface (i.e. seating lines 66, 68) on the outer valve 28. An offset is dressed into the profile of the grinding wheel 82 between the first and second profile regions. The offset is selected so as to give the required gap D between the inner and outer valves 26, 28 when they are assembled together into the nozzle body 12 and engaged with their respective seatings 58, 70. The offset is identified in FIG. 6 at X and corresponds to a gap setting D.

The method of manufacture described above is beneficial for the following reasons. As the only tolerance on the gap D is the accuracy with which the offset on the grinding wheel 82 can be set, which is very high, the gap D can be set with high accuracy. Furthermore, the method required for forming the inner and outer valve profiles is a less complex method than that required to form the equivalent profiles in known nozzles in which the outer valve 28 lifts first, before lifting the inner valve needle 26.

As an alternative method to that described previously, the inner and outer valves 26, 28 may be formed as separate parts with appropriately shaped, different grinding wheels being used to form each one, and with the grinding wheel profiles being offset by an appropriate amount as described above. However, this method is likely to be less accurate than a method which forms both needles 26, 28 together (as illustrated in FIG. 6).

Figure 7A:
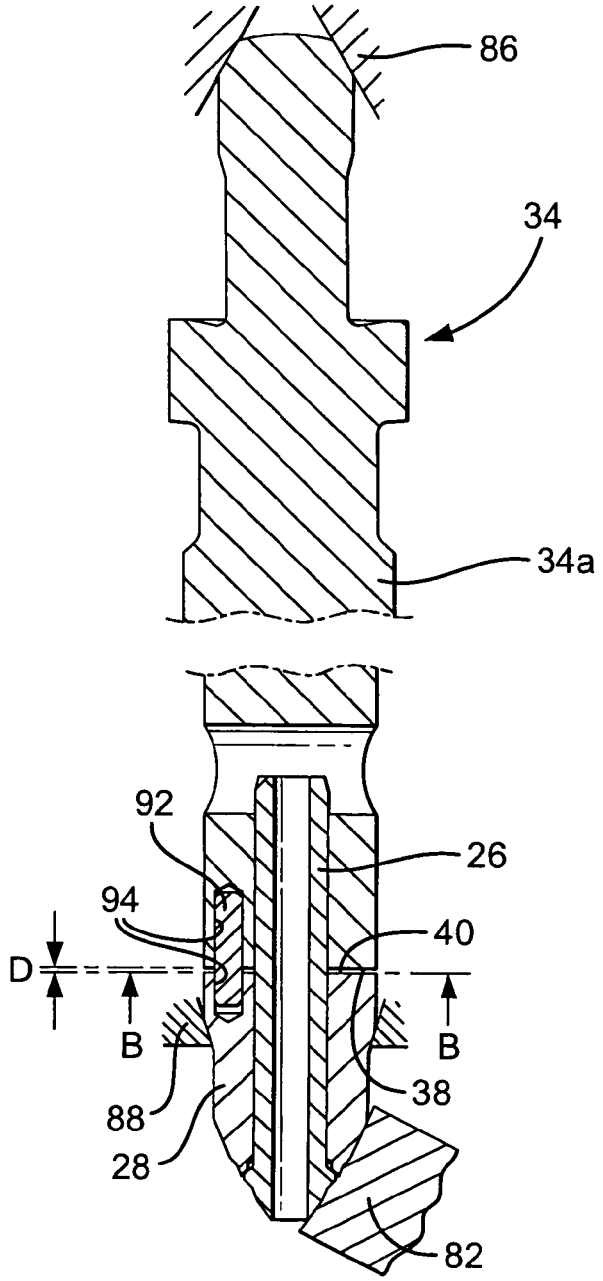
FIG. 7*a* is a sectional view of the injection nozzle of FIGS. 1 to 5 to illustrate an alternative example of a manufacturing process.
Figure 7B:
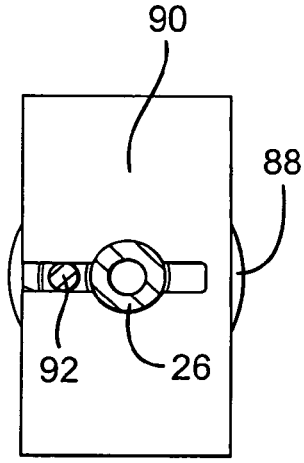
FIG. 7*b* is a sectional view, along line B—B, of the injection nozzle in FIG. 7*a*.

An alternative method to that described with reference to FIG. 6 will now be described with reference to FIGS. 7*a* and 7*b*. A similar apparatus to that shown in FIG. 6 is utilised, but in this case the inner valve needle 26 and the load transmitting member 34 are first assembled together with the outer valve 28. An end of the load transmitting member 34 is then supported in a first centre or support 86, with a second centre or support 88 being provided to support an outer surface of the outer valve 28. A shim or spacer member 90 is assembled between the upper surface 40 of the outer valve 28 and the facing, lower surface 38 of the load transmitting member 34. The grinding wheel 82 is profiled so as to form, simultaneously, the upper and lower seating lines, 66, 68 and 50, 52 respectively, on each of the inner and outer valves 26, 28. An anti-rotation or locating feature may be provided to further improve concentricity of the parts 26, 28 during the grinding process. For example, the locating feature may take the form of a dowel 92 located within correspondingly formed drillings 94 in the inner and outer valves 26, 28. When grinding of the valve needles 26, 28 is completed, the shim 90 is removed and the inner and outer valves 26, 28 are then assembled into the nozzle body 12.

The shim 90 is preferably selected so as to have a thickness equal to the required gap D (i.e. so that the upper surface 40 of the outer valve 28 and the lower face 38 of the load transmitting member 34 are separated by distance D). In this case, when the inner and outer valves 26, 28 are assembled into the nozzle body 12 no further setting of parts (e.g. pressing the valves into the seats) is required. Alternatively, in a modification to this method, the shim 90 may be selected so as to have a thickness which is greater than that of the required gap D. Once the valve needles 26, 28 have been ground and assembled into the nozzle body 12, the final gap dimension D can be set by pressing the valve needles 26, 28 into the nozzle body 12 so as to engage with the valve seating surface 24. This modified method is likely to provide higher accuracy than a method in which the shim 90 is selected to have the exact thickness of the gap D, and will provide similar accuracy to the method described with reference to FIG. 6. A further advantage is achieved as the uppermost end of the load transmitting member 34 is held on the first centre 86 and the surface of the outer valve 28 is held on the second centre 88, as this allows the guide region 34*a* of the load transmitting member 34 to be ground or shaped during the same grinding phase as for the valve needles 26, 28.

It will be understood by those who practice the invention and those skilled in the art, that various modifications and improvements may be made to the invention without departing from the spirit and scope of the invention as defined by the claims.

The invention claimed is:

1. An injection nozzle (10) for use in a fuel injector for an internal combustion engine, the injection nozzle comprising:

an inner valve needle (26) which is engageable with an inner valve seating (24, 58) to control fuel delivery through one or more first nozzle outlets (14), an outer valve (28) which is engageable with an outer valve seating (24, 70) to control fuel delivery through one or more second nozzle outlets (16), wherein the outer valve (28) is provided with a valve bore (36) within which at least a part (26*a*) of the inner valve needle (26) is received, and a coupling arrangement (46, 48) for coupling movement of the inner valve needle (26) to the outer valve (28) in circumstances in which the inner valve needle (26) is moved away from the inner valve seating (24, 58) through an amount exceeding a predetermined threshold amount (D), thereby to cause the outer valve (28) to lift away from the outer valve seating (24, 70) also.

2. The injection nozzle (10) as claimed in claim 1, wherein the coupling arrangement includes an engagement surface (46) defined by the inner valve needle (26) for engagement with a co-operable surface (48) defined by the outer valve (28).

3. The injection nozzle (10) as claimed in claim 2, wherein the engagement surface (46) of the inner valve needle (26) is defined between a main stem (26*a*) of the inner valve needle (26) and an enlarged head (26*b*) of the inner valve needle (26).

4. The injection nozzle (10) as claimed in claim 1, wherein the inner valve needle (26) is provided with upper and lower seating lines (50, 52), spaced one on either side of the first nozzle outlets (14) in circumstances in which the inner valve needle (26) is seated, wherein the upper and lower seating lines (50, 52) are engageable with respective upper and lower seats (60, 62) of the inner valve seating (24, 58).

5. The injection nozzle (10) as claimed in claim 4, wherein the upper and lower seating lines (50, 52) of the inner valve needle (26) are defined by upper and lower edges, respectively, of a groove (54) provided on the inner valve needle (26), the groove (54) comprising an upper groove region (54*a*) of frusto-conical form to define the upper edge and a lower groove region (54*b*) of frusto-conical form to define the lower edge.

6. The injection nozzle (10) as claimed in claim 1, wherein the outer valve (28) is provided with upper and lower seating lines (66, 68), spaced one on either side of the second nozzle outlets (16) in circumstances in which the outer valve (28) is seated, wherein the upper and lower seating lines (66, 68) are engageable with upper and lower seats (76, 78), respectively, of the outer valve seating (24, 70).

7. The injection nozzle (10) as claimed in claim 6, wherein the upper and lower seating lines (66, 68) of the outer valve (28) are defined by upper and lower edges, respectively, of a groove (64) provided on the outer valve (28), said groove (64) comprising an upper groove region (64*a*) of frusto-conical form to define the upper edge and a lower groove region (64*b*) of frusto-conical form to define the lower edge.

8. The injection nozzle (10) as claimed in claim 1, comprising a nozzle body (12) provided with a nozzle bore (18), wherein the nozzle bore (18) defines an upper delivery chamber (20) for delivering fuel to the first and second nozzle outlets (14, 16) and a lower delivery chamber (22) for delivering fuel to the first and second nozzle outlets, wherein the upper and lower delivery chambers (20, 22) communicate with one another.

9. The injection nozzle as claimed in claim 8, wherein the inner valve needle (26) defines, at least in part, a flow passage (44) to allow fuel to flow from the upper delivery chamber (20) towards the lower delivery chamber (22).

10. The injection nozzle (10) as claimed in claim 9, wherein the flow passage includes an axially extending bore (44) provided in the inner valve needle (26).

11. The injection nozzle (10) as claimed in claim 10, including an actuator for actuating the inner valve needle (34), wherein the inner valve needle (26) is coupled to the actuator via a load transmitting member (34) and wherein the load transmitting member (34) also defines a part of the flow passage (44, 47).

12. The injection nozzle (10) as claimed in claim 1, including an actuator for actuating the inner valve needle (34), wherein the inner valve needle (26) is coupled to the actuator via a load transmitting member (34).

13. The injection nozzle (10) as claimed in claim 11, wherein the load transmitting member (34) includes a guide region (34*a*) which serves to guide movement of the load transmitting member (34) and the inner valve needle (26), in use.

14. An injection nozzle (10) for use in a fuel injector for an internal combustion engine, the injection nozzle comprising:

an inner valve needle (26) which is engageable with an inner valve seating (24, 58) to control fuel delivery through one or more first nozzle outlets (14) and operable by means of an actuator to move away from the inner valve seating (24, 58), an outer valve (28) which is engageable with an outer valve seating (24, 70) to control fuel delivery through one or more second nozzle outlets (16), wherein the outer valve (28) is provided with a valve bore (36) within which at least a part (26*a*) of the inner valve needle (26) is received, and the inner valve needle (26) having a region (48) which cooperates with a region (46) of the outer valve (28) in circumstances in which the inner valve needle (26) is moved away from the inner valve seating (24, 58) through an amount exceeding a predetermined threshold amount (D), thereby to cause the outer valve (28) to lift away from the outer valve seating (24, 70) together with the inner valve needle (26), and where the regions (46, 48) remain disengaged when the inner valve needle (26) is moved away from the inner valve seating (24, 58) through an amount less than the predetermined threshold amount (D).

15. The injection nozzle as claimed in claim 14, wherein the inner valve needle (26) is coupled to the actuator via an intermediate load transmitting part (34).

16. The injection nozzle as claimed in claim 15, wherein the inner valve needle (26) and the load transmitting part (34) are provided with internal passages to define a flow path for fuel to the first nozzle outlets (14).

17. The injection nozzle (10) as claimed in claim 14, wherein the inner valve needle (26) is provided with upper and lower seating regions (50, 52), spaced one on either side of the first nozzle outlets (14) in circumstances in which the inner valve needle (26) is seated, wherein the upper and lower seating regions (50, 52) are engageable with respective upper and lower seat regions (60, 62) of the inner valve seating (24, 58).

18. The injection nozzle (10) as claimed in claim 14, wherein the outer valve (28) is provided with upper and lower seating regions (66, 68), spaced one on either side of the second nozzle outlets (16) in circumstances in which the outer valve (28) is seated, wherein the upper and lower seating regions (66, 68) are engageable with upper and lower seats (76, 78), respectively, of the outer valve seating (24, 70).

19. A method of manufacture of the injection nozzle (10) as claimed in claim 1, the method including the steps of;

receiving at least a part (26*a*) of the inner valve needle (26) within the outer valve (28), providing a grinding wheel (82) having a first surface profile for profiling the outer surface of the inner valve needle (26) and a second surface profile for profiling the outer surface of the outer valve (28), and grinding the inner valve needle (26) and the outer valve (28) with the wheel to profile respective seating surfaces thereof, wherein the first and second surface profiles of the grinding wheel (82) are offset from one another so that, when the inner and outer valves (26, 28) are engaged with their respective valve seatings (24, 58, 70) when the nozzle (10) is assembled, engageable surfaces (46, 48) of the inner and outer valves (26, 28) are separated by the threshold amount (D).

20. The method as claimed in claim 19, including the step of clamping the outer valve (28) into contact with the inner valve needle (26) by engaging an engagement surface (46) of the inner valve needle (26) with a co-operable surface (48) of the outer valve (28).

* * * * *